US007909023B2

(12) United States Patent
Aoki

(10) Patent No.: US 7,909,023 B2
(45) Date of Patent: Mar. 22, 2011

(54) FUEL SUPPLY SYSTEMS

(75) Inventor: Tsuneaki Aoki, Kariya (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 340 days.

(21) Appl. No.: 12/258,636

(22) Filed: Oct. 27, 2008

(65) Prior Publication Data

US 2009/0126698 A1 May 21, 2009

(30) Foreign Application Priority Data

Nov. 19, 2007 (JP) ..... 2007-299161

(51) Int. Cl.
*F02M 33/08* (2006.01)
*F02M 37/04* (2006.01)

(52) U.S. Cl. ..... 123/516; 123/511; 123/506; 123/457; 123/461

(58) Field of Classification Search ..... 123/510, 123/511, 514, 516, 506, 446, 457, 461, 462
See application file for complete search history.

(56) References Cited

U.S. PATENT DOCUMENTS

| | | | | |
|---|---|---|---|---|
| 6,260,543 | B1 * | 7/2001 | Chih | 123/509 |
| 6,343,589 | B1 | 2/2002 | Talaski et al. | |
| 6,532,941 | B2 * | 3/2003 | Begley et al. | 123/497 |
| 6,986,341 | B2 * | 1/2006 | Mitani et al. | 123/520 |
| 7,077,112 | B2 * | 7/2006 | Mitani et al. | 123/518 |
| 7,431,020 | B2 * | 10/2008 | Ramamurthy | 123/497 |
| 2006/0291995 | A1 * | 12/2006 | Ikeya | 415/55.1 |
| 2009/0084361 | A1 * | 4/2009 | Harper et al. | 123/510 |

FOREIGN PATENT DOCUMENTS

JP 2001248512 9/2001

* cited by examiner

*Primary Examiner* — Hai H Huynh
(74) *Attorney, Agent, or Firm* — Dennison, Schultz & MacDonald

(57) ABSTRACT

A fuel supply system that includes a fuel pump, a jet pump, a first device and a second device. The fuel pump has a first port, a second port and a third port. Each of the first and second ports is configured to discharge a pressurized fuel. The third port is configured to discharge a fuel vapor that may be produced within the fuel pump. The first port is coupled to an engine via a fuel supply passage. The first device is coupled between the second port and the jet pump and is operable to permit and prevent the supply of the pressurized fuel to the jet pump. The second device is coupled to the third port and is operable to permit and prevent the discharge of the fuel vapor to the outside of the second device.

9 Claims, 8 Drawing Sheets

FUEL SUPPLY SYSTEMS

This application claims priority to Japanese patent application serial number 2007-299161, the contents of which are incorporated herein by reference.

BACKGROUND OF THE INVENTION

1. Field of the Invention

The present invention relates to fuel supply systems used mainly for engines of vehicles.

2. Description of the Related Art

A known fuel supply system is disclosed, for example, in Japanese Laid-Open Patent Publication No. 2001-248512. The fuel supply system of this publication includes a fuel pump for supplying fuel stored within a fuel tank to a side of an engine, a pressure regulating valve for regulating the pressure of pressurized fuel supplied from the fuel pump to the side of the engine and for discharging surplus fuel, and a jet pump driven by a flow of the surplus fuel discharged from the pressure regulating valve. Typically, a general fuel pump is provided with a vapor jet (also known as a vapor escape hole or a vapor discharge hole, etc.) formed at a pump housing in order to discharge vapor that is generated within a pump passage due to the rotational movement of an impeller driven by a motor so that fuel vapor generated within the pump passage is discharged trough the vapor jet out of the pump while the fuel is pressurized.

However, the conventional fuel supply system disclosed in the above publication does not control discharge of fuel vapor through the vapor jet provided to the fuel pump. According to this construction, even if almost no vapor is generated when the pressure has been increased to a system fuel pressure (system fuel pressure is a fuel pressure within a fuel supply passage and is a normal fuel pressure level within a fuel supply system), i.e., at increasing pressure, pressurized fuel may be discharged through the vapor jet. As a result, a loss of flow of the pressurized fuel may be large and it may cause increase in load applied to the fuel pump. Further, because the jet pump is configured to be driven by the flow of the surplus fuel, it may cause a problem that the amount of fuel pumped by the jet pump may become instable due to the change of an amount of the surplus fuel.

Therefore, there is a need for a fuel supply system that can reduce a load applied to a fuel pump during increase of a system fuel pressure and can stabilize the amount of fuel pumped by a jet pump.

SUMMARY OF THE INVENTION

One aspect according to the present invention includes a fuel supply system that includes a fuel pump, a jet pump, a first device and a second device. The fuel pump has a first port, a second port and a third port. Each of the first and second ports is configured to discharge a pressurized fuel. The third port is configured to discharge a fuel vapor that may be produced within the fuel pump. The first port is coupled to an engine via a fuel supply passage. The first device is coupled between the second port and the jet pump and is operable to permit and prevent the supply of the pressurized fuel to the jet pump. The second device is coupled to the third port and is operable to permit and prevent the discharge of the fuel vapor to the outside of the second device.

DETAILED DESCRIPTION OF THE INVENTION

Figure 1:
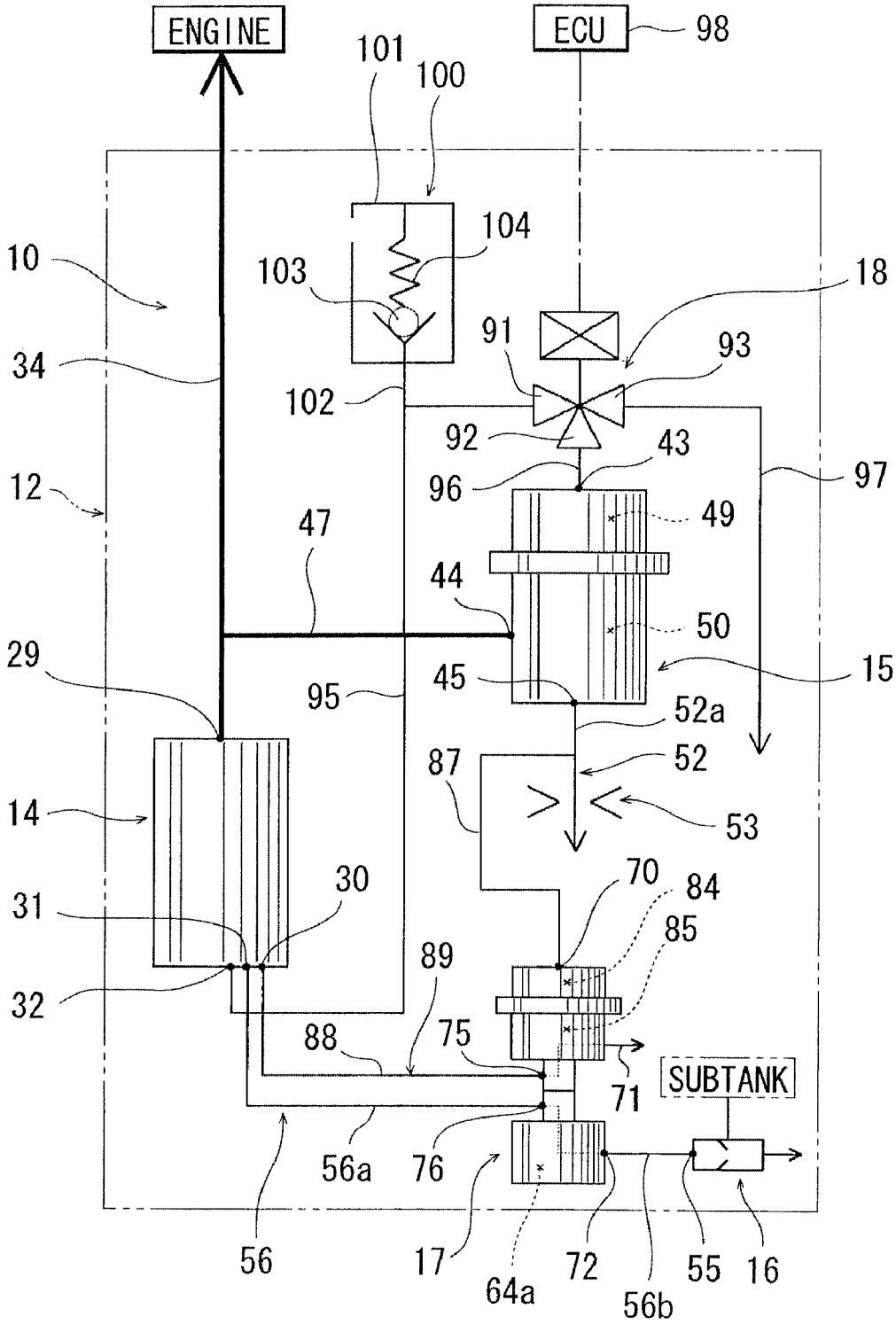
FIG. 1 is a schematic view of a fuel supply system according to a first representative embodiment.

Each of the additional features and teachings disclosed above and below may be utilized separately or in conjunction with other features and teachings to provide improved fuel supply systems. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel supply system includes a fuel pump configured to supply fuel within a fuel tank to a side of an engine and having a vapor jet configured to discharge fuel vapor. A fuel vapor passage permits the fuel vapor discharged from the vapor jet of the fuel pump to flow therethrough. A pressure regulating valve regulates a fuel pressure within a pressure regulating chamber, into which the pressurized fuel discharged from the fuel pump is introduced, based on a pressure within a back pressure chamber, and to discharge surplus fuel. A surplus fuel passage permits the surplus fuel discharged from the pressure regulating valve to flow therethrough. A throttle portion is provided in the surplus fuel passage. A jet pump is driven by a flow of the pressurized fuel and permits the pressurized fuel discharged from the fuel pump to be introduced therein via a jet pump fuel passage. A valve can open and close the fuel vapor passage and the jet pump fuel passage in a manner opposite to each other based on a pressure of the surplus fuel within an upstream passage portion of the surplus fuel passage. The upstream passage portion is positioned on an upstream side of the throttle portion. The valve is operable to close the jet pump fuel passage and to open the fuel vapor passage when the surplus fuel pressure is less than a threshold value, and the valve is operable to open the jet pump fuel passage and to close the fuel vapor passage when the surplus fuel pressure is equal to or higher than the threshold value.

With this arrangement, the valve opens the fuel vapor passage and closes the jet pump fuel passage if surplus fuel pressure within the upstream passage portion positioned on the upstream side of the throttle portion of the surplus fuel passage is less than the threshold value due to generation of vapor. For example, the vapor may tend to be generated during increase of fuel pressure at a low voltage operating condition, for example, directly after starting the engine.

Because the jet pump is stopped by blocking the jet pump fuel passage while the fuel vapor is discharged through the fuel vapor passage, an amount of pressurized fuel supplied to a side of the engine can be increased. Accordingly, it is possible to reduce the size of the fuel pump and therefore to reduce the power consumption of the fuel pump because the jet pump is stopped within a driving region that determines the size of the fuel pump.

The jet pump fuel passage is opened as the fuel vapor passage is closed by means of the valve if the surplus fuel pressure is equal to or above a threshold value when almost no vapor is generated. For example, almost no vapor may be generated if the fuel pump driven under a normal condition and the pressure has been increased to a system fuel pressure, or if the fuel pump is driven in an operating condition, in which an amount of the surplus fuel pressure is increasing. Therefore, it is possible to reduce a load applied to the fuel pump driven to provide the increased system fuel pressure because the pressurized fuel is prevented from being discharged through the vapor jet as the fuel vapor passage is blocked. In addition, the jet pump can be driven by a flow of the pressurized fuel that is introduced via the jet pump fuel passage. In this way, because an amount of pressurized fuel for driving the jet pump can be maintained substantially uniform by utilizing the pressurized fuel discharged from the fuel pump for driving the jet pump, an amount of fuel pumped by the jet pump can be stabilized.

As a result, it is possible to reduce a load applied to the fuel pump that is driven to provide the system fuel pressure. It is also possible to stabilize an amount of fuel pumped by the jet pump.

In another embodiment, a first open/close valve can open and close the fuel vapor passage. A second open/close valve can open and close the jet pump fuel passage. The first and the second open/close valves can be opened and closed in a manner opposite to each other based on a pressure of the surplus fuel within an upstream passage portion of the surplus fuel passage. The upstream passage is positioned on an upstream side of the throttle portion. The second open/close valve closes the jet pump fuel passage while the first open/close valve opens the fuel vapor passage when the surplus fuel pressure is less than a threshold value. The second open/close valve opens the jet pump fuel passage while the first open/close valve closes the fuel vapor passage when the surplus fuel pressure is equal to or higher than the threshold value.

The fuel pressure within the pressure regulating chamber of the pressure regulating valve, i.e., a pressure of fuel supplied to the side of the engine can be varied by opening and closing a back pressure fuel passage by means of a valve device to change a pressure of a pressurized fuel, which is applied to the back pressure chamber of the pressure regulating valve. Therefore, the atomization of injected fuel injected from an injector(s) of the engine can be promoted by increasing the fuel pressure within the pressure regulating chamber of the pressure regulating valve, for example, at the start of the engine. As a result, it is possible to improve the startability of the engine and to reduce an emission. In addition, a load applied to the fuel pump, etc. can be reduced by reducing the fuel pressure within the pressure regulating chamber of the pressure regulating valve after starting the engine.

An upstream throttle portion and a downstream throttle portion may be provided in the back pressure fuel passage. The fuel flowing through an intermediate passage portion defined between the upstream throttle portion and the downstream throttle portion is introduced into the back pressure chamber of the pressure regulating valve. Therefore, it is possible to reduce the pressure of fuel applied to the back pressure chamber of the pressure regulating valve when the pressurized fuel to be supplied to the engine is introduced into the back pressure fuel passage.

Although a load applied to a fuel pump may be increased in order to obtain high fuel pressure when the engine is started at a low temperature, the load applied to the fuel pump as well as the size of the fuel pump can be reduced by stopping the fuel supply to the jet pump by means of the valve device.

First Embodiment

A first representative embodiment will now be described with reference to FIG. 1. In this embodiment, a fuel supply system is exemplified that is used for a vehicle engine. As shown in FIG. 1, a fuel supply system 10 is mounted on a vehicle (not shown) and is provided within a fuel tank 12 for storing fuel. The fuel tank 12 is formed to have a plurality of tank chambers and the fuel supply system 10 is disposed within a main tank chamber (for example, in a reservoir cup provided within the main tank chamber).

Figure 3:
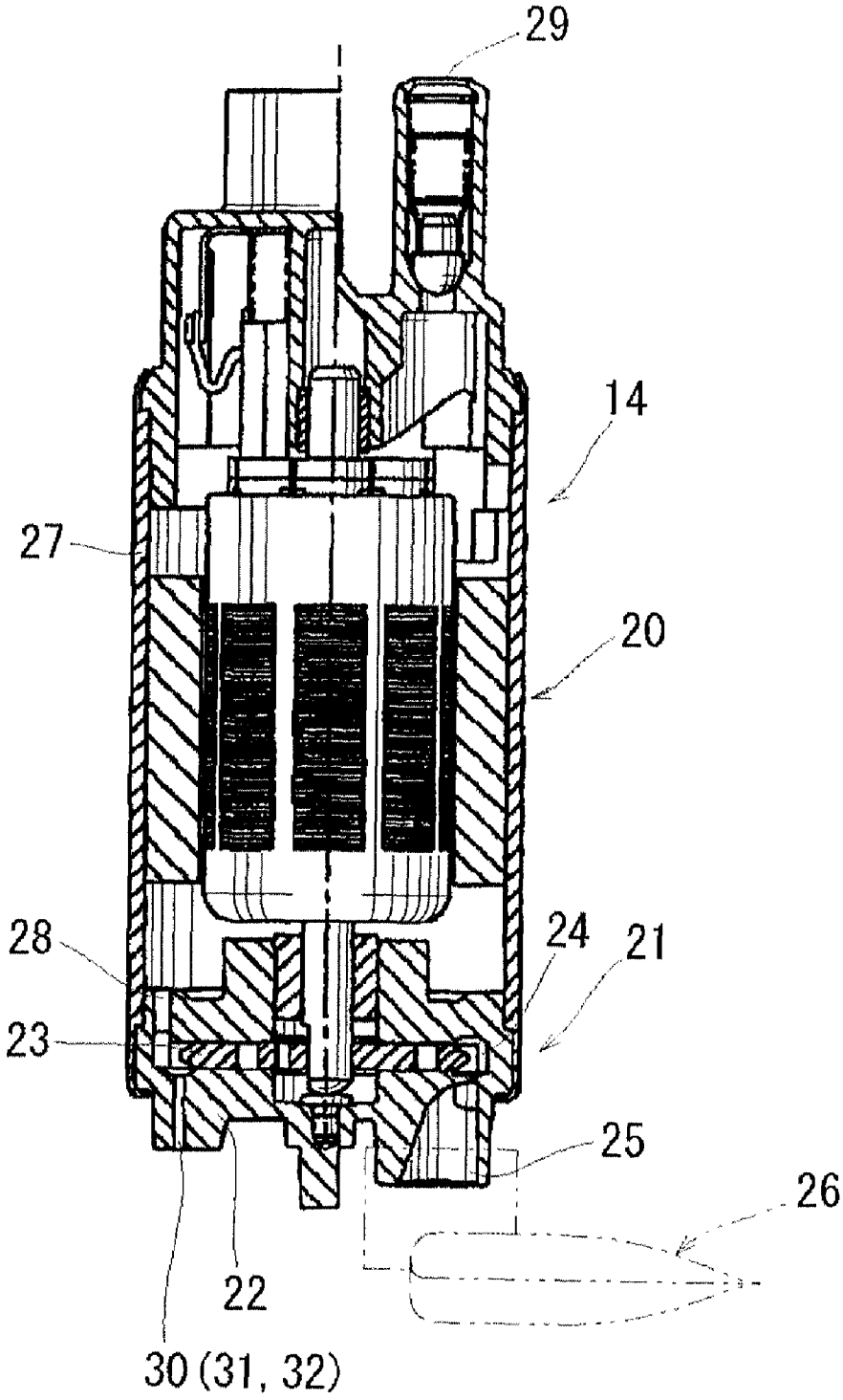
FIG. 3 is a cross sectional view of a fuel pump.

The fuel supply system 10 includes a fuel pump 14, a pressure regulating valve 15, a jet pump 16, a changeover valve 17 and a valve device 18, etc. that serve as the main components of the fuel supply system 10. As shown in FIG. 3, the fuel pump 14 is configured as a motor-integrated in-tank fuel pump and has an electric motor section 20 and an impeller pump section 21 that is disposed at a lower end of the motor section 20. The fuel pump 14 serves to supply fuel within the fuel tank 12 to the side of an engine. As the motor section 20 is actuated to rotate an impeller 23 within a pump housing 22, the pump section 21 draws and pressurizes the fuel within the fuel tank 12 and discharges the fuel into the motor section 20. A pump channel 24 having a C-shaped configuration is formed in the pump housing 22 along an outer circumferential portion of the impeller 23. A fuel inlet port 25 for drawing fuel is disposed at a lower surface side of the pump housing 22 and communicates with a start end portion of the pump channel 24. An inlet filter 26 for filtering the fuel is connected to the fuel inlet port 25. An outflow port 28 that communicates with the start end portion of the pump channel 24 and discharges the fuel into a motor housing 27 of the motor section 20, is provided on an upper surface side of the pump housing 22. A fuel discharge port 29 for discharging the fuel that has passed through the motor housing 27 is provided on an upper surface side of the motor housing 27.

A vapor jet 30 is provided on the lower surface side of the pump housing 22 for discharging the fuel during the pressurizing process, i.e., the fuel containing vapor (gas bubbles generated due to evaporation of the fuel) from the pump channel 24 to the outside. A first fuel outlet port 31 and a second fuel outlet port 32 are disposed on the lower surface side of the pump housing 22. The first fuel outlet port 31 communicates with the pump channel 24 at a position on the downstream side of the vapor jet 30 and serves to discharge thed fuel during the pressurizing process from the pump channel 24 to the outside. The second fuel outlet port 32 communicates with the pump channel 24 at a position on the downstream side of the first fuel outlet port 31 and serves to discharge the fuel during the pressurizing process from the pump channel 24 to the outside.

As shown in FIG. 1, one end of a fuel supply passage 34 is connected to the fuel discharge port 29 of the fuel pump 14. The fuel supply passage 34 extends from the side of the fuel tank 12 towards the side of an engine. Although not shown, the other end of the fuel supply passage 34 is connected to a delivery pipe having injectors (fuel injection valves) corresponding to respective combustion chambers of the engine. Therefore, the pressurized fuel discharged from the fuel pump 14 is supplied to the delivery pipe on the side of the engine via the fuel supply passage 34, and is injected into the combustion chambers of the engine by the corresponding injectors.

Figure 4:
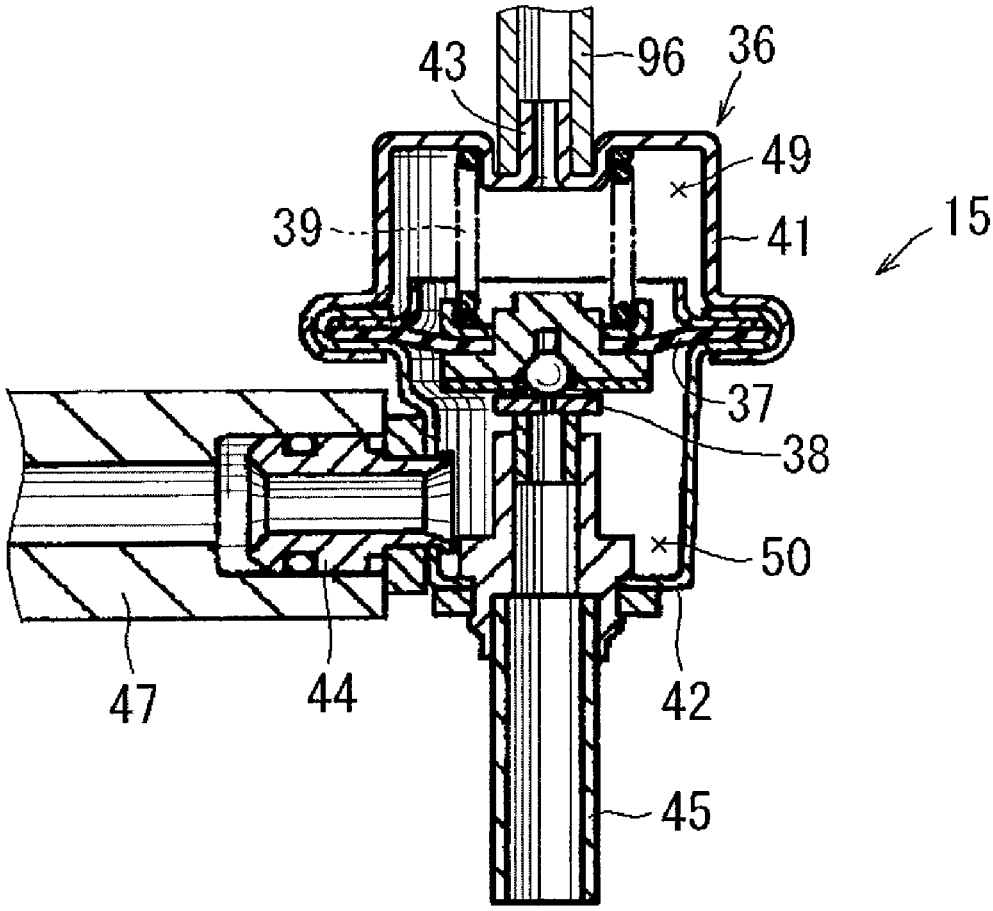
FIG. 4 is a cross sectional view of a pressure regulating valve.

Further, the pressure regulating valve 15 will be described. The pressure regulating valve 15 serves to regulate the pressure of the fuel that is supplied to the fuel supply passage 34 by the fuel pump 14. As shown in FIG. 4, the pressure regulating valve 15 includes a casing 36, a diaphragm 37, a valve body 38 and a valve spring 39, etc. that serve as the main components of the pressure regulating valve 15. The casing 36 is formed to have an upper casing portion 41 with a lower opening and a lower casing portion 42 with an upper opening, which is joined to the lower surface side of the upper casing portion 41. A communication port 43 is positioned at an upper wall portion of the upper casing portion 41. The lower casing portion 42 has a fuel introducing pipe 44 attached to a side wall portion of the lower casing portion 42 and a fuel discharge pipe 45 attached to a bottom wall portion of the lower casing portion 42. The fuel introducing pipe 44 communicates with a pressurized fuel introducing passage 47 that is branched from the fuel supply passage 34 within the fuel tank 12 (see FIG. 1). Therefore, a part of the pressurized fuel that flows through the fuel supply passage 34 is introduced into the lower casing portion 42 and the fuel pressure is applied within the lower casing portion 42.

As shown in FIG. 4, the diaphragm 37 is clamped between both casing portions 41 and 42 of the casing 36, and divides an inner space of the casing 36 into an upper back pressure chamber 49 and a lower pressure regulating chamber 50. The diaphragm 37 is made of rubber-like resilient material having a flexibility. The diaphragm 37 may be also called "a movable partition wall".

The valve body 38 is mounted to a center portion of the diaphragm 37. Due to the flexural deformation of the diaphragm 37, the valve body 38 can open and close the fuel discharge pipe 45 while an upper end surface of the fuel discharge pipe 45 serves as a valve seat.

The valve spring 39 is interposed between opposing surfaces of the upper casing portion 41 and the valve body 38 and normally biases the valve body 38 in a closing direction.

Consequently, the valve body 38 is closed due to the resilient force of the valve spring 39, if a force applied to the diaphragm 37 due to the fuel pressure within the pressure regulating chamber 50 of the pressure regulating valve 15 is lower than a force applied to the diaphragm 37 within the back pressure chamber 49 due to the resilient force of the valve spring 39 greater than the resilient force of the valve spring 39, the valve body 38 is opened against the resilient force of the valve spring 39. As a result, the fuel within the pressure regulating chamber 50 is discharged via the fuel discharge pipe 45 so that the fuel pressure within the pressure regulating chamber 50 is reduced to the predetermined value. When the fuel pressure within the pressure regulating chamber 50 has been reduced to a predetermined value, the valve body 38 is closed due to the resilient force of the valve spring 39.

A surplus fuel passage 52 communicates with the fuel discharge pipe 45 of the pressure regulating valve 15 so that surplus fuel discharged from the fuel discharge pipe 45 can be discharged into the fuel tank 12 via the surplus fuel passage 52 (see FIG. 1). A throttle portion 53 for reducing a flow area is disposed on the way of the surplus fuel passage 52 so that fuel pressure (also called as "surplus fuel pressure") can be generated within a passage portion 52*a*, which is positioned on the upstream side of the throttle portion 53.

The jet pump 16 will be described. As shown in FIG. 1, a fuel introducing port 55 for introducing fuel for driving the jet pump 16 communicates with the first fuel outlet port 31 of the fuel pump 14 via a jet pump fuel passage 56. Accordingly, a part of the pressurized fuel within the pump passage 24 of the fuel pump 14 during the pressurizing process (see FIG. 3) is introduced into the jet pump 16 for dividing the same. The jet pump 16 serves to transfer fuel stored in one of tank chambers (such as a sub-tank chamber) into the other one of the tank chambers (such as a main tank chamber) due to a suction force produced by a negative pressure that may be generated by the flow of the driving fuel.

Figure 2:
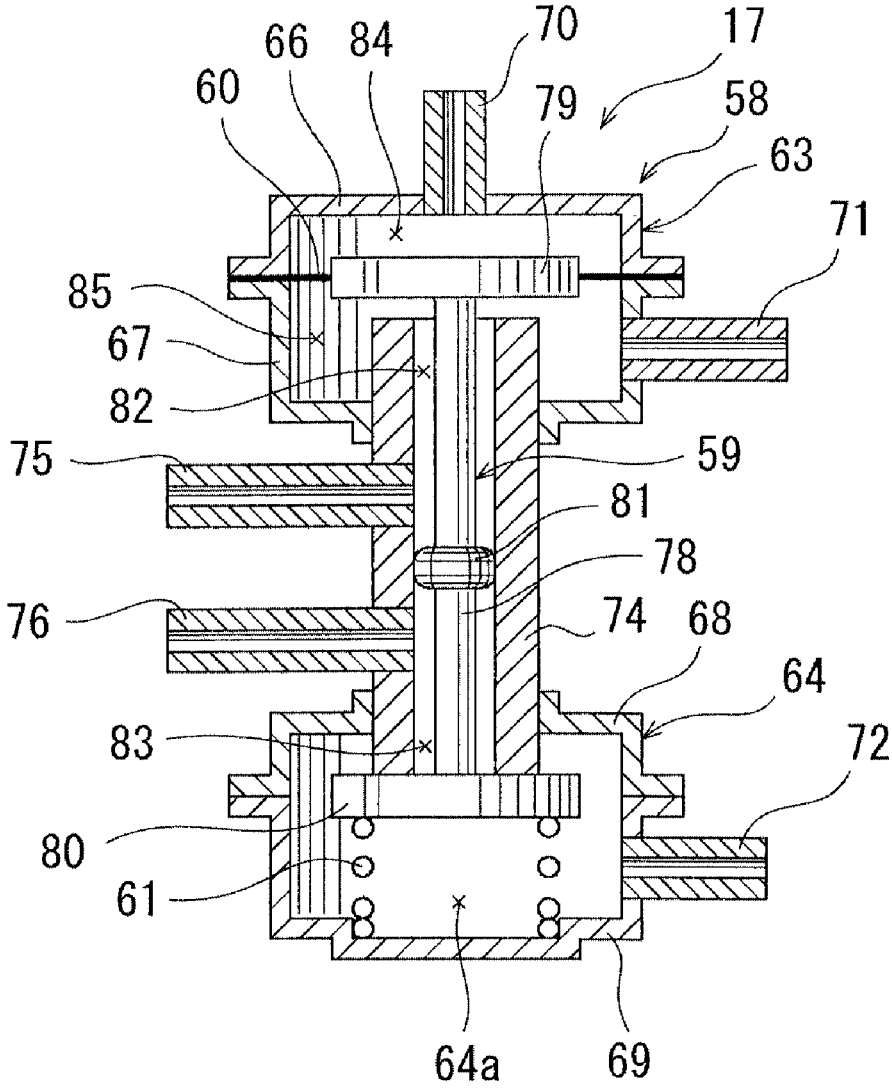
FIG. 2 is a cross sectional view of a changeover valve.

The changeover valve 17 will be described. As shown in FIG. 2, the changeover valve 17 includes a casing 58, a valve member 59, a diaphragm 60 and a valve spring 61, etc., that serve as the main components of the changeover valve 17. The casing 58 has a first casing body 63 and a second casing body 64 that are vertically aligned with each other. The first casing body 63 is formed to have an upper casing portion 66 with a lower surface having an opening and a lower casing portion 67 with an upper opening, which is joined to the lower surface side of the upper casing portion 66. The second casing portion 64 is formed to have an upper casing portion 68 with a lower opening and a lower casing portion 69 with an upper opening, which is joined to the lower surface side of the upper casing portion 68. A surplus fuel introducing port 70 is provided on an upper wall portion of the upper casing portion 66 of the first casing body 63. A fuel vapor discharge port 71 is provided on a side wall portion of the lower casing portion 67 of the first casing body 63. A pressurized fuel discharge port 72 is provided on a side wall portion of the lower casing portion 69 of the second casing body 64.

A lower wall portion of the lower casing portion 67 of the first casing body 63 and an upper wall portion of the upper casing portion 68 of the second casing body 64 are connected to each other by means of a cylindrical casing portion 74 that is formed to have a hollow cylindrical configuration extending in a vertical direction. The inside of the first casing body 63 and the inside of the second casing body 64 are communicated with each other through the inside of the cylindrical casing portion 74. Upper and lower end portions of the cylindrical casing portion 74 protrude into casing bodies 63 and 64, respectively. A fuel vapor introducing port 75 is formed on an upper portion of the side surface of the cylindrical casing portion 74. A pressurized fuel introducing port 76 is formed on a lower portion of the side surface of the cylindrical casing portion 74.

The valve member 59 includes a valve shaft 78, a first valve body 79, a second valve body 80 and a flange-like partition wall portion 81 that are formed integrally with each other. The valve shaft 78 is loosely inserted into the cylindrical casing portion 74. The first valve body 79 is provided on an upper end portion of the valve shaft 78 and serves to open and close the cylindrical casing portion 74. An upper end surface of the cylindrical casing portion 74 serves as a valve seat. The second valve body 80 is provided on a lower end portion of the valve shaft 78 and serves to open and close a lower end surface of the cylindrical casing portion 74 as a valve seat. The partition wall portion 81 is provided on a middle portion of the valve shaft 78 and slidably contacts with an inner circumferential surface of the cylindrical casing portion 74. The partition wall portion 81 divides an annular space formed between the cylindrical casing portion 74 and the valve shaft 78 into an upper communication passage 82 and a lower communication passage 83. The upper communication passage 82 communicates within the fuel vapor introducing port 75 and the first casing body 63. The lower communication passage 83 communicates within the pressurized fuel introducing port 76 and the second casing body 64.

The diaphragm 60 is clamped between both casing portions 66, 67 of the first casing body 63 and divides an inner space of the casing body 63 into an upper back pressure chamber 84 and a lower fuel vapor chamber 85. The first valve body 79 of the valve member 59 is joined to a center portion of the diaphragm 60. The diaphragm 60 is made of a rubber-like resilient material and has a flexibility. The diaphragm 60 may be referred to as "a movable partition wall".

The valve spring 61 is interposed between the opposing surfaces of the upper casing portion 68 of the second casing body 64 and the second valve body 80 of the valve member 59 and normally biases the valve member 59 in an upward direction. Therefore, the second valve body 80 is resiliently maintained in a closing position and the first valve body 79 is maintained in an opening position.

As shown in FIG. 1, a surplus fuel introducing passage 87 communicates with the surplus fuel introducing port 70. The surplus fuel introducing passage 87 is branched from the upstream passage portion 52*a* of the surplus fuel passage 52, which is positioned on the upstream side of the throttle portion 53. Therefore, a part of surplus fuel flowing within the surplus fuel passage 52 is introduced into the back pressure chamber 84 of the changeover valve 17 and accordingly, the surplus fuel pressure produced within the upstream passage portion 52*a*, which is positioned on the upstream side of the throttle portion 53, is applied within the back pressure chamber 84.

The vapor jet 30 of the fuel pump 14 communicates with the fuel vapor introducing port 75 via a fuel vapor introducing passage 88. The fuel vapor introducing passage 88, the upper communication passage 82 (see FIG. 2), the fuel vapor chamber 85 and the fuel vapor discharge port 71 are arranged in series with each other to constitute a fuel vapor passage 89 (see FIG. 1).

As shown in FIG. 1, the jet pump fuel passage 56 for communicating the first fuel outlet port 31 of the fuel pump 14 with the fuel introducing port 55 for introducing fuel for driving the jet pump 16 is divided into an upstream passage portion 56*a* and a downstream passage portion 56*b*. A downstream end of the upstream passage portion 56*a* communicates with the pressurized fuel introducing port 76 and an upstream end of the downstream passage portion 56*b* communicates with the pressurized fuel discharge port 72. The upstream passage portion 56*a*, the lower communication passage 83 (see FIG. 2), an inner space 64*a* of the second casing body 64 and the downstream passage portion 56*b* are arranged in series with each other to constitute the jet pump fuel passage 56 (FIG. 1). In order to eliminate influences of the pressure at the jet pump 16, which may be a high pressure, an outer diameter of the diaphragm 60 is determined to have a larger diameter than an outer diameter of the partition wall portion 81 of the valve shaft 78.

When the force produced by the surplus fuel pressure applied to the diaphragm 60 within the back pressure chamber 84 of the changeover valve 17 is smaller than the resilient force of the valve spring 61, the valve member 59 moves upward due to the resilient force of the valve spring 61. As a result, the fuel vapor passage 89 is opened by the first valve body 79 and the jet pump fuel passage 56 is closed by the second valve body 80. When the force produced by the surplus fuel pressure within the back pressure chamber 84 is larger than the resilient force of the valve spring 61, the valve member 59 moves downward against the resilient force of the valve spring 61 so that the fuel vapor passage 89 is closed by the first valve body 79 and the jet pump fuel passage 56 is closed by the second valve body 80. Accordingly, the changeover valve 17 opens and closes the fuel vapor passage 89 and the jet pump fuel passage 56 in a manner opposite to each other in response to the surplus fuel pressure.

The valve device 18 will be described. As shown in FIG. 1, the valve device 18 is an electromagnetic three-way changeover valve and has first, second and third connection ports 91, 92 and 93. The first connection port 91 communicates with the second fuel outlet port 32 of the fuel pump 14 via the back pressure fuel passage 95. The second connection port 92 communicates with the communication port 43 of the pressure regulating valve 15, i.e., the back pressure chamber 49 via a communication passage 96. The third connection port 93 communicates with an opening passage 97 that is opened into the fuel tank 12. The valve device 18 is switched ON/OFF based on control signals that are outputted from the electronic control unit 98 (referred to as "ECU"). When the valve device 18 is switched ON, the first connection port 91 and the second connection port 92 are communicated with each other while the third connection port 93 is blocked. As a result, the pressurized fuel pressure (back pressure) applied to the back pressure fuel passage 95 is applied further to the back pressure chamber 84 of the changeover valve 17. When the valve device 18 is switched OFF, the second communication port 92 and the third communication opening 93 are communicated with each other while the first connection port 91 is blocked. Consequently, the inside of the back pressure chamber 84 of the changeover valve 17 is opened into the atmosphere, i.e., into the fuel tank 12 via the communication passage 96 and the opening passage 97.

The ECU 98 is a control unit that may include a microcomputer, etc. A detecting device, for detecting the operation of an ignition switch or a starting switch, etc. of an engine, is connected to an input side of the ECU 98. An injector(s), etc. is/(are) connected to an output side of the ECU 98. The ECU 98 serves to perform ON/OFF control of the valve device 18 based on the driving condition of an engine. For example, the ECU 98 switches the valve device 18 ON at the start of the engine (at the time of switching ON an ignition switch or a starting switch) and maintains the valve device 18 to be switched ON until a predetermined period of time has passed after the engine has started. The ECU 98 switches the valve device 18 OFF after the predetermined period of time has passed. The ECU 98 may be called a "control unit".

A pressure relief valve 100 is disposed on the way of the back pressure fuel passage 95. The pressure relief valve 100 serves to control the fuel pressure, which is applied to the back pressure chamber 49 of the pressure regulating valve 15, to be equal to or less than a predetermined pressure. The pressure relief valve 100 has a case 101, a relief path 102 extending into and out of the case 101 and communicating with a midway of the back pressure fuel passage 95, a valve body 103 that can open and close the relief path 102, and a spring 104 for resiliently biasing the valve body 103 of the pressure relief valve 100 in a closing direction. When the force applied by the fuel pressure within the back pressure fuel passage 95 becomes greater than the resilient force of the spring 104, the valve body 103 of the pressure relief valve 100 is opened against the resilient force of the spring 104. Accordingly, the pressurized fuel within the back pressure fuel passage 95 is released into the fuel tank 12 through the relief path 102 and the fuel pressure within the back pressure fuel passage 95 is reduced to a predetermined value. Once the fuel pressure within the back pressure fuel passage 95 has reached the predetermined value, the valve body 103 is closed due to the resilient force of the spring 104.

The fuel pump 14, the pressure regulating valve 15, the changeover valve 17, the valve device 18 and the pressure relief valve 100 are fixedly positioned within the fuel tank 12.

The operation of the fuel supply system 10 will be described. For the convenience of explanation, a switching function for the fuel passages (the jet pump fuel passage 56 and the fuel vapor passage 89) by means of the changeover valve 17 will be explained after a function of the valve device 18 for varying the fuel pressure is described.

A function of the valve device 18 for varying the fuel pressure will be described. When the engine is started, the valve device 18 is switched ON based on control signals outputted from the ECU 98. Then the first connection port 91 and the second connection port 92 of the valve device 18 are communicated with each other so that the pressure of the pressurized fuel supplied into the back pressure passage 95 is applied to the inside of the back pressure chamber 49 of the pressure regulating valve 15. In addition, the fuel stored in the back pressure chamber 49 can be prevented from blowing out of the back pressure chamber 49 because the third connection port 93 of the valve device 18 is blocked.

When the pressure of the pressurized fuel is applied to the inside of the back pressure chamber 49 of the pressure regulating valve 15 (see FIG. 4), the diaphragm 37 flexurally deforms towards the side of the pressure regulating chamber 50 due to the increased fuel pressure within the back pressure chamber 49. As the valve body 38 is closed due to the flexural deformation of the diaphragm 37, the outflow of fuel stored in the pressure regulating chamber 50 is restricted. As a result, the fuel pressure within the pressure regulating chamber 50 is further increased. If the fuel pressure within the pressure regulating chamber 50 exceeds the total value of the force applied by the fuel pressure within the pressure regulating chamber 50 and the resilient force of the valve spring 39, the diaphragm 37 flexurally deforms towards the side of the back pressure chamber 49. Accordingly, the valve body 38 is opened and the fuel within the pressure regulating chamber 50 may be discharged as surplus fuel. When the fuel pressure within the fuel regulating chamber 50 is reduced again, the diaphragm 70 flexurally deforms towards the side of the pressure regulating chamber 50 to close the valve body 38. In this way, the fuel pressure within the pressure regulating chamber 50, i.e., the fuel pressure supplied to an engine, is regulated to have a pressure value, for example, around 600 kPa, which is higher than a normal pressure value. Therefore, it is possible to promote the atomization of the fuel injected by the injector, improve startability of an engine and reduce an emission. The valve device 18 is maintained switched ON during an engine start period, more specifically, a period from the beginning of starting an engine (at the time of switching ON, for example, an ignition switch or a starting switch) until a predetermined period of time has passed after the engine has started.

The valve device 18 is switched OFF based on control signals outputted from the ECU 98 after a predetermined period of time has passed after starting the engine. Then the first connection port 91 of the valve device 18 is blocked and therefore, the pressure of the pressurized fuel may not be applied to the inside of the back pressure chamber 49. Further, because the second connection port 92 and the third connection port 93 of the valve device 18 communicate with each other, the back pressure chamber 49 is opened to the atmosphere, i.e., into the fuel tank 12 via the communication passage 96 and the opening passage 97. Consequently, the force applied to the diaphragm 37 within the back pressure chamber 49 may only be the resilient force of the valve spring 39 so that the fuel pressure within the pressure regulating chamber 50, more particularly, the fuel pressure supplied to an engine may be regulated to have a normal pressure value, for example, around 400 kPa. In this way, a load, which may be applied to the fuel pump 14, etc., can be reduced. The ON condition of the valve device 18 may be a "high pressure condition" and the OFF condition of the valve device 18 may be a "normal pressure condition".

A switching function for the fuel passages (the jet pump fuel passage 56 and the fuel vapor passage 89) by means of the changeover valve 17 (see FIG. 2) will be described.

Surplus fuel is discharged from the pressure regulating valve 15 into the surplus fuel passage 52 via the fuel discharge pipe 45. The amount of the surplus fuel, which is discharged into the fuel tank 12, is reduced due to a throttle function of the throttle portion 53. Consequently, a surplus fuel pressure is generated within the upstream passage portion 52*a*. The surplus fuel pressure is introduced into the back pressure chamber 84 of the changeover valve 17 via the surplus pressure introducing passage 87.

The resilient force of the valve spring 61 may be greater than surplus fuel pressure when the vapor is easily generated as in the time especially immediately after starting an engine and when the surplus fuel pressure within the back pressure chamber 84 is less than a predetermined threshold value in an operating area of the fuel pump 14, in which the pressure within the fuel pump 14 is increasing while the fuel pump is driven by a low voltage. Therefore, the fuel vapor passage 89 is opened by the first valve body 79 as the valve member 59 for the changeover valve 17 moves upward due to the resilient force of the valve spring 61 while the jet pump fuel passage 56 is closed by the second valve body 80. Consequently, the fuel vapor introduced from the vapor jet 30 of the fuel pump 14 is discharged into the fuel tank 12 via the fuel vapor passage 89. On the other hand, since the jet pump 16 is stopped as the jet pump fuel passage 56 is closed, the amount of pressurized fuel supplied to the side of the engine can be increased. As a result, it is possible to reduce a size of the pump section of the fuel pump 14 and therefore to reduce a current consumption of the fuel pump 14 by stopping the jet pump 16 within a driving region that may determine a size of the fuel pump 14.

When almost no vapor is generated as in the case where the fuel pump 14 is operated in normal operation mode and the fuel pressure within the fuel supply system has reached a system fuel pressure (i.e., a fuel pressure within the fuel supply passage 34 and provides a normal fuel pressure level within the fuel supply system) that provides a pressure increased condition, the amount of surplus fuel is increased. When the surplus fuel pressure within the back pressure chamber 84 increases to be equal to or above a threshold value, the surplus fuel pressure becomes greater than the resilient force of the valve spring 61. Therefore, the valve member 59 moves downward against the resilient force of the valve spring 61 due to the downward flexural deformation of the diaphragm 60 caused by the surplus fuel pressure, and therefore, the fuel vapor passage 89 is closed by the first valve body 79 while the jet pump fuel passage 56 is opened by the second valve body 80. Accordingly, it is possible to limit the outflow of the fuel vapor from the vapor jet 30 of the fuel pump 14 by closing the fuel vapor passage 89. In addition, as the jet pump fuel passage 56 is opened, a part of pressurized fuel during increase in pressure within the fuel pump passage 24 of the fuel pump 14 is introduced into the jet pump 16 as driving fuel in order to drive the jet pump 16. Accordingly, fuel stored in one of tank chambers (such as a sub-tank chamber) may be transferred into the other tank chamber (such as a main tank chamber) or fuel stored in one of tank chambers (such as a main tank chamber) may be transferred into the other tank chamber (such as a reservoir cup). Therefore, it is possible to stabilize the amount of fuel pumped by the jet pump 16 since the amount of pressurized fuel for driving the jet pump 16 can be maintained uniform by using fuel discharged from the fuel pump 14, i.e., fuel during increase in pressure as fuel for driving the jet pump 16.

According to the above mentioned fuel supply system 10 (see FIG. 1), it is possible to reduce a load applied to the fuel pump 14 at the system fuel pressure with the pressure increased and to stabilize the amount of fuel pumped by the jet pump 16.

Further, because the changeover valve 17 (see FIG. 2) has a simple mechanical structure, it is possible to reduce cost due to simplification of the structure. In addition, since the changeover valve 17 is configured to switch by utilizing surplus fuel pressure, it is not necessary to make change to the ECU 98.

The fuel pressure within the pressure regulating chamber 50 of the pressure regulating valve 15, i.e., the pressure of fuel supplied to the side of an engine, can be changed as the fuel pressure of the pressurized fuel applied to the back pressure chamber 49 of the pressure regulating valve 15 is changed by switching ON/OFF the valve device 18. Accordingly, the atomization of fuel injected from the injector disposed on the side of an engine can be promoted by increasing the fuel pressure within the pressure regulating chamber 50 of the pressure regulating valve 15 at the start of an engine. Therefore, it is possible to improve startability of an engine and reduce an emission. Further, it is possible to reduce a load applied to the fuel pump 14, etc., by reducing fuel pressure within the pressure regulating chamber 50 of the pressure regulating valve 15 after starting an engine.

Because the valve device 18 is a three-way changeover valve, a single valve device 18 can selectively switch between introduction of the pressurized fuel pressure into the back pressure chamber 49 of the pressure regulating valve 15 and release of the fuel from the back pressure chamber 49 into the atmosphere. Accordingly, the construction of the system may be simplified compared to the construction utilizing a plural number of valve devices. An example of the construction utilizing the plural number of valve devices may be as follows: The valve device 18 and the communication passage 96 in the above embodiment may be omitted so that the back pressure fuel passage 95 and the opening passage 97 may be individually communicated with the back pressure chamber 49 of the pressure regulating valve 15. At the same time, valve devices, such as electromagnetic ON/OFF valves, may respectively be installed into the back pressure fuel passage 95 and the opening passage 97. The introduction of fuel into the back pressure chamber 49 of the pressure regulating valve 15 and the release of fuel from the back pressure chamber 49 into the atmosphere may selectively be switched by controlling the valve devices to open and close by means of ECU 98. It is, therefore, also included within the scope of the present invention to selectively switch the introduction of the fuel into the back pressure chamber 49 of the pressure regulating valve 15 and the release from the back pressure chamber 49 by utilizing a plural number of valve devices.

Further, fuel pressure within the back pressure chamber 49 of the pressure regulating valve 15 may be controlled to have a pressure equal to or less than a predetermined pressure level by the pressure relief valve 100 (see FIG. 1). The relief path 102 for the pressure relief valve 100 may be directly communicated with the inside of the back pressure chamber 49 for the pressure regulating valve 15 instead of the back pressure fuel passage 95.

Second Embodiment

The second representative embodiment is a modification of a part of the first representative embodiment. Therefore, only the modified part will be explained in order to avoid the repetition.

Figure 5:
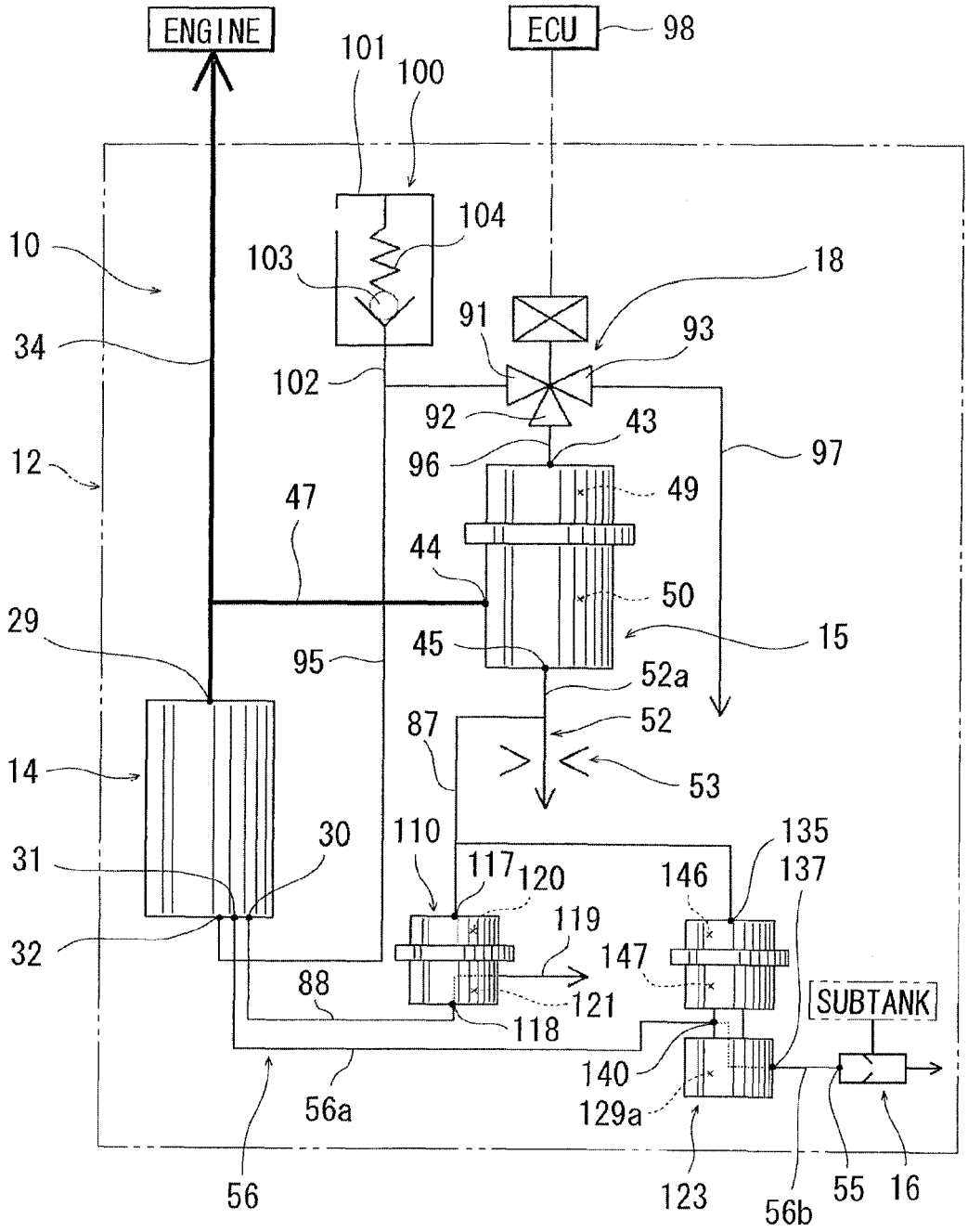
FIG. 5 is a schematic view of a fuel supply system according to a second embodiment.

As shown in FIG. 5, instead of using the changeover valve 17 (see FIG. 1) for the fuel supply system 10 as described in the first representative embodiment, a first open/close valve 110 for opening and closing the fuel vapor passage 89 is used in combination with a second open/close valve 123 for opening and closing the back pressure fuel passage 95 instead of using the changeover valve 17. Both open/close valves 110 and 123 are fixedly disposed within the fuel tank 12.

Figure 6:
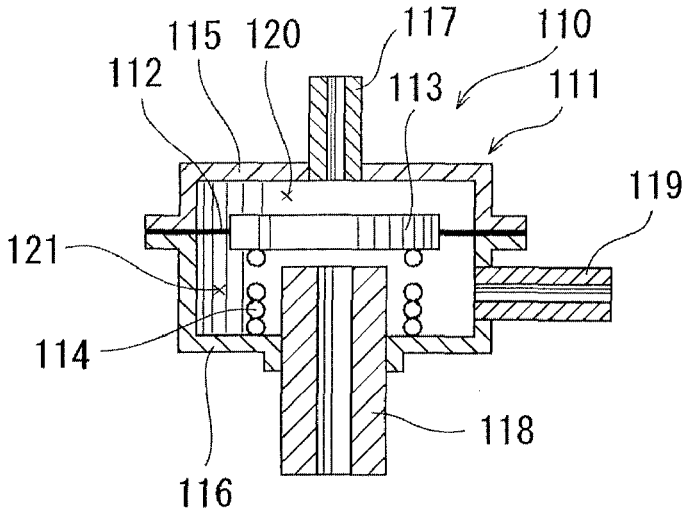
FIG. 6 is a cross sectional view of a first opening/closing valve.

As shown in FIG. 6, the first open/close valve 110 includes a casing 111, a diaphragm 112, a valve body 113 and a valve spring 114 etc., that serve as main components of the first open/close valve 110. The casing 111 has an upper casing portion 115 with a lower surface having an opening and a lower casing portion 116 with an upper surface having an opening, which is joined to the lower surface side of the upper casing portion 115. A surplus fuel introducing port 117 is attached to an upper wall portion of the upper casing portion 115. A fuel vapor introducing pipe 118 is attached to a bottom wall portion of the lower casing portion 116. A fuel vapor discharge port 119 is provided to a side wall portion of the lower casing portion 116.

The diaphragm 112 is clamped between the upper casing portion 115 and the lower casing portion 116 of the casing 111 and divides an inner space of the casing 111 into an upper back pressure chamber 120 and a lower fuel vapor chamber 121. The diaphragm 112 is made of rubber-like resilient material and has a flexibility. The diaphragm 112 may be also referred to as "a movable partition wall".

The valve body 113 is disposed at a center portion of the diaphragm 112 and serves to open and close an upper open end of the fuel vapor introducing pipe 118 due to a flexural deformation of the diaphragm 112. Therefore, the upper end surface of the fuel vapor introducing pipe serves as a valve seat.

The valve spring 114 is interposed between opposing surfaces of the lower casing portion 116 and the valve body 113 and always biases the valve body 113 in a direction away from the upper end surface of the fuel vapor introducing pipe 118, i.e., in a valve opening direction.

An upstream passage portion 52*a*, which is positioned on the upstream side of the throttle portion 53 of the surplus fuel passage 52 communicates with the surplus fuel introducing port 117 via the surplus fuel introducing passage 87. Therefore, a part of surplus fuel passing through the surplus fuel passage 52 is introduced into the back pressure chamber 120. In addition, the pressure of the surplus fuel supplied into the upstream passage portion 52*a* positioned on the upstream side of the throttle portion 53 is applied into the back pressure chamber 120.

A vapor jet 30 of the fuel pump 14 communicates with the fuel vapor introducing pipe 118 via the fuel vapor introducing passage 88. The fuel vapor introducing passage 88, the fuel vapor introducing pipe 118, the fuel vapor chamber 121 and the fuel vapor discharge port 119 are arranged in series with each other to constitute a fuel vapor passage 89.

When the force to press the diaphragm 117 applied by the surplus fuel pressure within the back pressure chamber 120 of the first open/close valve 110 is smaller than the resilient force of the valve spring 114, the valve body 113 is moved upward to open the fuel vapor passage 89 due to the resilient force of the valve spring 114. When the force applied by the surplus pressure within the back pressure chamber 120 is larger than the resilient force of the valve spring 114, the valve body 113 moves downward to close the fuel vapor passage 89 against the resilient force of the valve spring 114.

Figure 7:
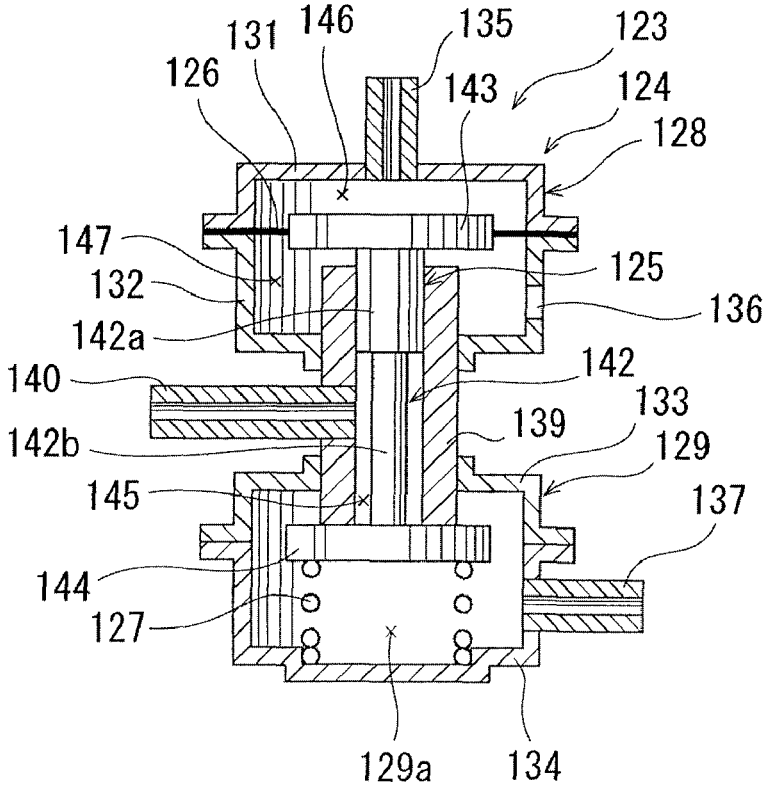
FIG. 7 is a cross sectional view of a second opening/closing valve.

As shown in FIG. 7, the second open/close valve 123 includes a casing 124, a valve member 125, a diaphragm 126 and a valve spring 127, etc., that serve as main components of the second open/close valve 123. The casing 124 has a first casing body 128 and a second casing body 129 that are vertically aligned with each other. The first casing body 128 has an upper casing portion 131 with a lower opening and a lower casing portion 132 with an upper opening, which is joined to the lower surface side of the upper casing portion 131. The second casing body 129 has an upper casing portion 133 with a lower opening and a lower casing portion 134 with an upper opening, which is joined to the lower surface side of the upper casing portion 133. The first casing body 128 is provided with a surplus fuel introducing port 135 disposed to an upper wall portion of the upper casing portion 133 and an opening hole 136 defined in a side wall portion of the lower casing portion 134. The second casing body 129 is provided with a pressurized fuel discharge port 137 disposed at a side wall portion of the lower casing portion 134.

A lower wall portion of the lower casing portion 134 of the first casing body 128 and an upper wall portion of the upper casing portion 133 of the second casing body 129 are connected with each other via a tubular casing portion 139 that is formed to have a hollow cylindrical configuration extending in a vertical direction. Consequently, an inside of the first casing body 128 and an inside of the second casing body 129 are communicated with each other through an inside of the tubular casing portion 139. Upper and lower end portions of the tubular casing portion 139 protrude into the casing bodies 128 and 129, respectively. A pressurized fuel introducing port 140 is formed at a center portion of the tubular casing portion 139.

The valve member 125 includes a valve shaft 142, a first valve body 143 and a second valve body 144 that are formed integrally with each other. The valve shaft 142 is inserted into the tubular casing portion 139. The first valve body 143 is disposed at an upper end portion of the valve shaft 142 and serves to open and close an upper end opening of the tubular casing portion 139. Thus, the upper end surface of the tubular casing portion 139 serves as a valve seat. The second valve body 144 is disposed at a lower end portion of the valve shaft 142 and serves to open and close a lower end opening of the tubular casing portion 139. Thus, the lower end surface of the tubular casing portion 139 serves as a valve seat. The valve shaft 142 has a large diameter shaft portion 142*a* and a small diameter shaft portion 142*b*. The large diameter shaft portion 142*a* is slidably fitted into an upper portion of the tubular casing portion 139. The small shaft portion 142*b* protrudes from a lower end surface of the large diameter shaft portion 142*a* coaxially therewith and is loosely fitted into a lower portion of the cylindrical casing portion 139. An annual space defined between the small diameter shaft portion 142*b* and the tubular casing portion 139 forms a communication path 145 that communicates with the pressurized fuel introducing port 140 and an inside of the second casing body 129. The large diameter shaft portion 142*a* separates an inner space of the first casing body 128 and an inner space of the communication path 145 from each other and always closes the upper open end of the tubular casing portion 139 independently of the vertical movement of the valve member 125. The first valve body 143 moves towards or away from the upper end surface of the cylindrical casing portion 139 in accordance with the vertical movement of the valve member 125 and serves substantially as a stopper when the valve member 125 moves downward.

The diaphragm 126 is clamped between the upper casing portion 131 and the lower casing portion 132 of the first casing body 128 and divides an inner space of the casing 101 into an upper back pressure chamber 146 and a lower atmosphere chamber 147. The atmosphere chamber 147 communicates with the atmosphere via the opening hole 136. The first valve body 143 of the valve member 125 is joined to the center portion of the diaphragm 126. The diaphragm 126 is made of rubber-like resilient material and has a flexibility. The diaphragm 126 is also referred to as "a movable partition wall".

The valve spring 127 is interposed between opposing surfaces of the upper casing portion 133 of the second casing body 129 and the second valve body 144 of the valve member 125 and always biases the valve member 125 in an upward direction. Therefore, the valve spring 127 resiliently maintains the first valve body 143 and the second valve body at an opening position and a closing position, respectively.

As shown in FIG. 5, a surplus fuel branch passage 148 communicates with the surplus fuel introducing port 135 of the second open/close valve 123 and is branched from the surplus fuel introducing passage 87. Therefore, a part of the surplus fuel passing through the surplus fuel passage 52 is introduces into the back pressure chamber 146 of the second open/close valve 123 via the surplus fuel branch passage 148 and a surplus fuel pressure may be applied within the upstream passage portion 52*a*, which is positioned on the upstream side of the throttle portion 53.

A downstream end of the upstream passage portion 56*a* of the jet pump fuel passage 56 communicates with the pressurized fuel introducing port 140. An upstream end of the downstream passage portion 56*b* of the jet pump fuel passage 56 communicates with the pressurized fuel discharge port 137. The upstream passage portion 56*a*, the communication path 145 (see FIG. 7), an inner space 129*a* formed within the second casing body 129 and the downstream passage portion 56*b* are arranged in series with each other to constitute a jet pump fuel passage 56 (see FIG. 5).

When the force produced by the pressure applied to the diaphragm 126, i.e., the surplus fuel pressure, within the back pressure chamber 146 of the second open/close valve 123 (see FIG. 7) is smaller than the resilient force of the valve spring 127, the valve member 125 moves upward due to the resilient force of the valve spring 127. As a result, the jet pump fuel passage 56 is closed by the second valve body 144 while the first valve body 143 moves away from the upper end surface of the tubular casing portion 139. When the force produced by the surplus fuel pressure within the back pressure chamber 146 is larger than the resilient force of the valve spring 127, the valve member 125 moves downward against the resilient force of the valve spring 127. As a result, the jet pump fuel passage 56 is opened by the second valve body 144 while the first valve body 143 contacts the upper end surface of the cylindrical casing portion 139.

According to the fuel supply system 10 (see FIG. 5), when the surplus fuel pressure applied to the back pressure chamber 120 of the first open/close valve 110 and the back pressure chamber 146 of the second open/close valve 123 is less than a threshold value, the first open/close valve 110 opens the fuel vapor passage 89 and the second open/close valve 123 closes the jet pump fuel passage 56, respectively. When the surplus pressure is equal to or higher than the threshold value, the first open/close valve 110 closes the fuel vapor passage 89 and the second open/close valve 123 opens the jet pump fuel passage 56, respectively. Accordingly, the first open/close valve 110 and the second open/close valve 123 open and close the fuel vapor passage 89 and jet pump fuel passage 56, respectively, in a manner opposite to each other, based on the surplus fuel pressure.

Third Embodiment

The third representative embodiment is a modification of a part of the first representative embodiment. Therefore, only the modified part will be explained in order to avoid the repetition.

Figure 8:
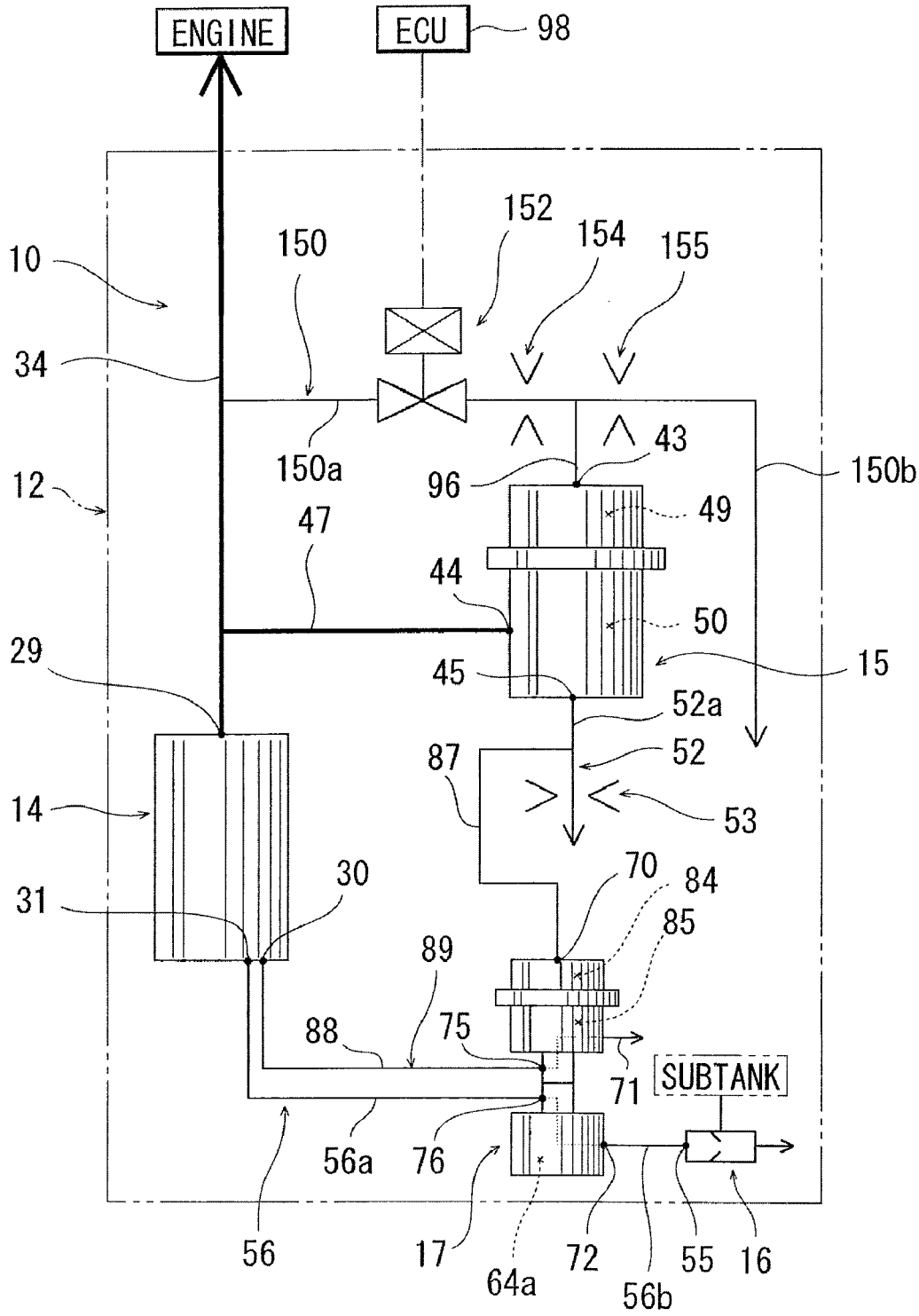
FIG. 8 is a schematic view of a fuel supply system according to a third embodiment.

Referring to FIG. 8, the third representative embodiment corresponds to a modification in a fuel pressure varying function performed by the valve device 18 of the fuel supply system 10 of the first representative embodiment (see FIG. 1). The valve device 18, the second fuel outlet port 32 of the fuel pump 14, the back pressure fuel passage 95 and the pressure relief valve 100 of the first embodiment are not incorporated.

A back pressure fuel passage 150 communicates with the fuel supply passage at a position on a downstream side of a branch point where the pressurized fuel introducing passage 47 is branched from the fuel supply passage 34. A valve device 152 constituted by an electromagnetic open/close valve is disposed on the way of the back pressure fuel passage 150. The valve device 152 divides the back pressure fuel passage 150 into an upstream passage portion 150*a* and a downstream passage portion 150*b*. A downstream end of the downstream passage portion 150*b* is opened into the fuel tank 12.

Two throttle portions, i.e., an upstream throttle portion 154 and a downstream throttle portion 155 are disposed on the way of the downstream passage portion 150*b* for reducing its passage area in a stepwise manner. A communication passage 96, which communicates with the communication port 43 of the pressure regulating valve 15, communicates with an intermediate passage portion positioned between the upstream throttle portion 154 and the downstream throttle portion 155. Consequently, fuel having an intermediate pressure and flowing through the intermediate passage portion between the upstream throttle portion 154 and the downstream throttle portion 155 is introduced into the back pressure chamber 49 of the pressure regulating valve 15 via the communication passage 96.

Similar to the valve device 18 (see FIG. 1) of the first representative embodiment, the valve device 152, is switched ON/OFF based on the control signals outputted from the ECU 98. When the valve device 152 is switched ON, the upstream passage portion 150*a* and the downstream passage portion 150*b* of the back pressure fuel passage 150 are communicated with each other so that a part of pressurized fuel flowing through the fuel supply passage 34 is introduced into the back pressure fuel passage 150. As a result, the fuel having the intermediate pressure and positioned between the throttle portions 154 and 155, which are disposed at the downstream passage portion 150*b* of the back pressure fuel passage 150, is introduced into the back pressure chamber 49 of the pressure regulating valve 15 via the communication passage 96. Therefore, the fuel pressure within the pressure regulating chamber 50 of the pressure regulating valve 15 is regulated to a higher level than a normal pressure level. When the valve device 18 is switched OFF, the back pressure fuel passage 150 is blocked. Therefore, the intermediate fuel pressure may not be applied into the back pressure chamber 49 of the pressure regulating valve 15 so that the fuel pressure within the pressure regulating chamber 50 of the pressure regulating valve 15, i.e., the fuel pressure supplied to an engine, is regulated to a normal pressure level. Accordingly, the fuel pressure within the pressure regulating chamber 50 of the pressure regulating valve 15 can be varied as the pressure of the pressurized fuel applied to the back pressure chamber 49 of the pressure regulating valve 15 is varied by switching ON/OFF the valve device 152.

Because the fuel flowing through the intermediate passage portion defined between the upstream throttle portion 154 and the downstream throttle portion 155 of the back pressure fuel passage 150 is introduced into the back pressure chamber 49 of the pressure regulating valve 15, it is possible to lower the pressure that is applied to the back pressure chamber 49 of the pressure regulating valve 15 during introduction of the pressurized fuel, which is adapted to be supplied to the engine, into the back pressure fuel passage 150. Accordingly, the pressure within the fuel supply passage 34 can be regulated to a predetermined pressure level.

Fourth Embodiment

The fourth representative embodiment is a modification of a part of the first representative embodiment. Therefore, only the modified part will be explained in order to avoid the repetition.

Figure 9:
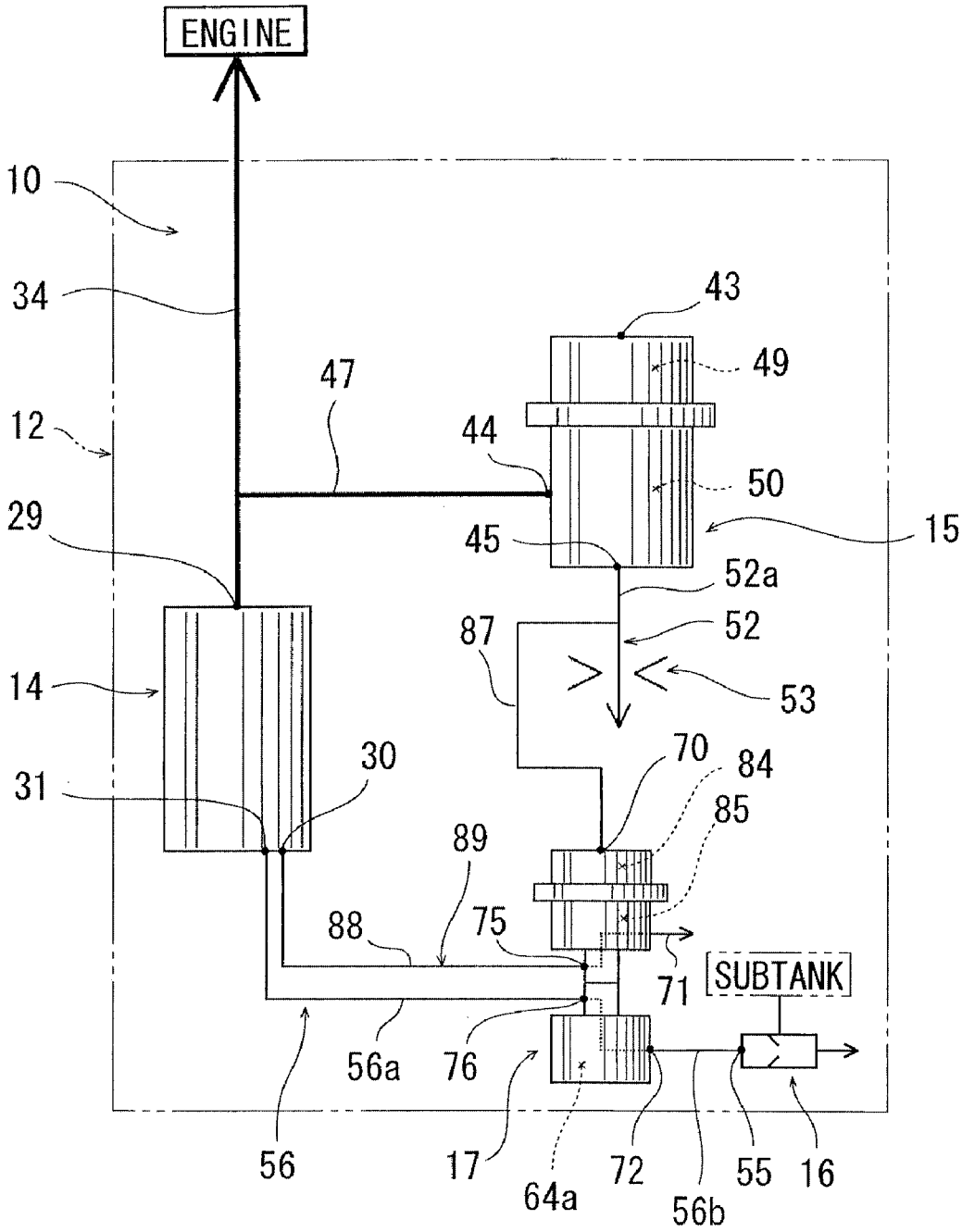
FIG. 9 is a schematic view of a fuel supply system according to a fourth embodiment.

As shown in FIG. 9, according the fourth embodiment, a fuel pressure varying function of the valve device 18 of the fuel supply system 10 of the first representative embodiment (see FIG. 1) is not incorporated. Therefore, in addition to the valve device 18, the second fuel outlet port 32, the back pressure fuel passage 95, the communication path 96 and the pressure relief valve 100 for the fuel pump 14 are not incorporated. According to the fourth representative embodiment, the fuel pressure within the fuel supply passage 34 can be maintained at a normal level.

This invention claims:

1. A fuel supply system comprising:

a fuel pump configured to supply fuel within a fuel tank to a side of an engine and having a vapor jet configured to discharge fuel vapor;

a fuel vapor passage configured to permit the fuel vapor discharged from the vapor jet of the fuel pump to flow therethrough;

a pressure regulating valve configured to regulate a fuel pressure within a pressure regulating chamber, into which the pressurized fuel discharged from the fuel pump is introduced, based on a pressure within a back pressure chamber, and to discharge surplus fuel;

a surplus fuel passage configured to permit the surplus fuel discharged from the pressure regulating valve to flow therethrough;

a throttle portion provided in the surplus fuel passage;

a jet pump configured to be driven by a flow of the pressurized fuel and to permit the pressurized fuel discharged from the fuel pump to be introduced therein via a jet pump fuel passage; and a valve constructed to open and close the fuel vapor passage and the jet pump fuel passage in a manner opposite to each other based on a pressure of the surplus fuel within an upstream passage portion of the surplus fuel passage, the upstream passage portion being positioned on an upstream side of the throttle portion;

wherein the valve is operable to close the jet pump fuel passage and to open the fuel vapor passage when the surplus fuel pressure is less than a threshold value, and the valve is operable to open the jet pump fuel passage and to close the fuel vapor passage when the surplus fuel pressure is equal to or higher than the threshold value.

2. A fuel supply system as defined in claim 1, further comprising:

a back pressure fuel passage configured to introduce the pressurized fuel into the back pressure chamber of the pressure regulating valve; and a valve device configured to open and close the back pressure fuel passage.

3. A fuel supply system as defined in claim 2, further comprising an upstream throttle portion and a downstream throttle portion provided in the back pressure fuel passage, wherein a fuel flowing through an intermediate passage portion defined between the upstream throttle portion and the downstream throttle portion is introduced into the back pressure chamber of the pressure regulating valve.

4. A fuel supply system comprising;

a fuel pump having a first port, a second port and a third port, each of the first and second ports being configured to discharge a pressurized fuel, and the third port being configured to discharge a fuel vapor that may be produced within the fuel pump;

wherein the first port is configured to be coupled to an engine via a fuel supply passage;

a jet pump;

a first device coupled between the second port and the jet pump and operable to permit and prevent the supply of the pressurized fuel to the jet pump; and a second device coupled to the third port and operable to permit and prevent the discharge of the fuel vapor to the outside of the second device.

5. The fuel supply system as in claim 4, wherein:

the first device permits the supply of the pressurized fuel to the jet pump when the second device prevents the fuel vapor from being discharged to the outside; and the first device prevents the supply of the pressurized fuel to the jet pump when the second device permits the fuel vapor to be discharged to the outside.

6. The fuel supply system as in claim 4, wherein the first device and the second device are integrated with each other.

7. The fuel supply system as in claim 4, further comprising a pressure regulator coupled to the fuel supply passage and configured to regulate a pressure of the fuel discharged from the first port, the pressure regulator having a discharge port for discharging a surplus fuel from the pressure regulator, wherein the first and second devices are operable based on the pressure of the surplus fuel.

8. The fuel supply system as in claim 7, further comprising a device for increasing the pressure of the surplus fluid.

9. The fuel supply system as in claim 4, wherein the pressure of the fuel discharged from the second port is lower than the pressure of the fuel discharged from the first port.

* * * * *